US010253977B2

(12) United States Patent
Goh et al.

(10) Patent No.: US 10,253,977 B2
(45) Date of Patent: Apr. 9, 2019

(54) GASEOUS FUEL-AIR BURNER HAVING A BLUFF BODY FLAME STABILIZER

(71) Applicant: Honeywell International Inc., Morristown, NJ (US)

(72) Inventors: Joseph Goh, Noblesville, IN (US); Brad Patterson, Dunkirk, IN (US); Edward Lovett, Parker City, IN (US)

(73) Assignee: Honeywell International Inc., Morris Plains, NJ (US)

( * ) Notice: Subject to any disclaimer, the term of this patent is extended or adjusted under 35 U.S.C. 154(b) by 494 days.

(21) Appl. No.: 15/064,328

(22) Filed: Mar. 8, 2016

(65) Prior Publication Data

US 2017/0261203 A1 Sep. 14, 2017

(51) Int. Cl.

| | |
|---|---|
| ***F23D 14/02*** | (2006.01) |
| ***F23D 14/58*** | (2006.01) |
| ***F23D 14/84*** | (2006.01) |
| ***F23C 9/00*** | (2006.01) |
| ***F23D 14/10*** | (2006.01) |
| ***F23D 14/70*** | (2006.01) |

(52) U.S. Cl.

CPC ..... *F23D 14/02* (2013.01); *F23C 9/006* (2013.01); *F23D 14/10* (2013.01); *F23D 14/58* (2013.01); *F23D 14/70* (2013.01); *F23D 14/84* (2013.01); *F23C 2202/40* (2013.01)

(58) Field of Classification Search

CPC ..... F23D 14/02; F23D 14/58; F23D 14/10; F23D 14/84

See application file for complete search history.

(56) References Cited

U.S. PATENT DOCUMENTS

| | | | | |
|---|---|---|---|---|
| 823,836 | A | 6/1906 | Wiemann | |
| 4,431,403 | A | 2/1984 | Nowak et al. | |
| 4,652,234 | A * | 3/1987 | Voorheis | F23D 14/34 239/562 |
| 5,259,755 | A | 11/1993 | Irwin et al. | |
| 6,702,571 | B2 | 3/2004 | Abbasi et al. | |
| 2007/0234938 | A1 * | 10/2007 | Briggs, Jr. | F23D 1/00 110/261 |

FOREIGN PATENT DOCUMENTS

| | | | |
|---|---|---|---|
| CN | 203980270 | U | 12/2014 |
| JP | H04103906 | A | 4/1992 |
| WO | 2014204333 | A1 | 12/2014 |

OTHER PUBLICATIONS

Search Report and Written Opinion from related European Patent Application No. 17157502, dated Jul. 11, 2017, 7 pages.

* cited by examiner

*Primary Examiner* — Avinash A Savani

(57) ABSTRACT

A gaseous fuel-air burner having a bluff body flame stabilizer, and methods of operating the same, are described herein. One device includes a bluff body configured to stabilize a flame produced by the gaseous fuel-air burner, wherein the bluff body has a conical shape configured to stabilize the flame by generating a recirculation zone having a stagnation point where the flame is stabilized.

17 Claims, 4 Drawing Sheets

GASEOUS FUEL-AIR BURNER HAVING A BLUFF BODY FLAME STABILIZER

TECHNICAL FIELD

The present disclosure relates to a gaseous fuel-air burner having a bluff body flame stabilizer, and methods of operating the same.

BACKGROUND

A gas burner can produce (e.g., generate) a flame using a gaseous fuel, such as hydrogen, propane, or natural gas. For example, a gaseous fuel-air burner may produce a flame by mixing a gaseous fuel with oxygen. Gaseous fuel-air burners may be used to produce flames in a number of industrial applications.

Gaseous fuel-air burners may utilize a bluff body to provide stabilization of the flame produced by the burner. For example, the bluff body may stabilize the flame by generating a recirculation zone having a stagnation point where the flame is able to be stabilized.

Previous burner bluff bodies may have a circular shape. For instance, previous burner bluff bodies may be in the shape of a circular plate or disk. Further, the position (e.g., location) of previous bluff bodies in the burner may be stationary (e.g., fixed). For instance, previous bluff bodies may remain in the same position in the burner during operation of the burner.

DETAILED DESCRIPTION

Figure 1A:
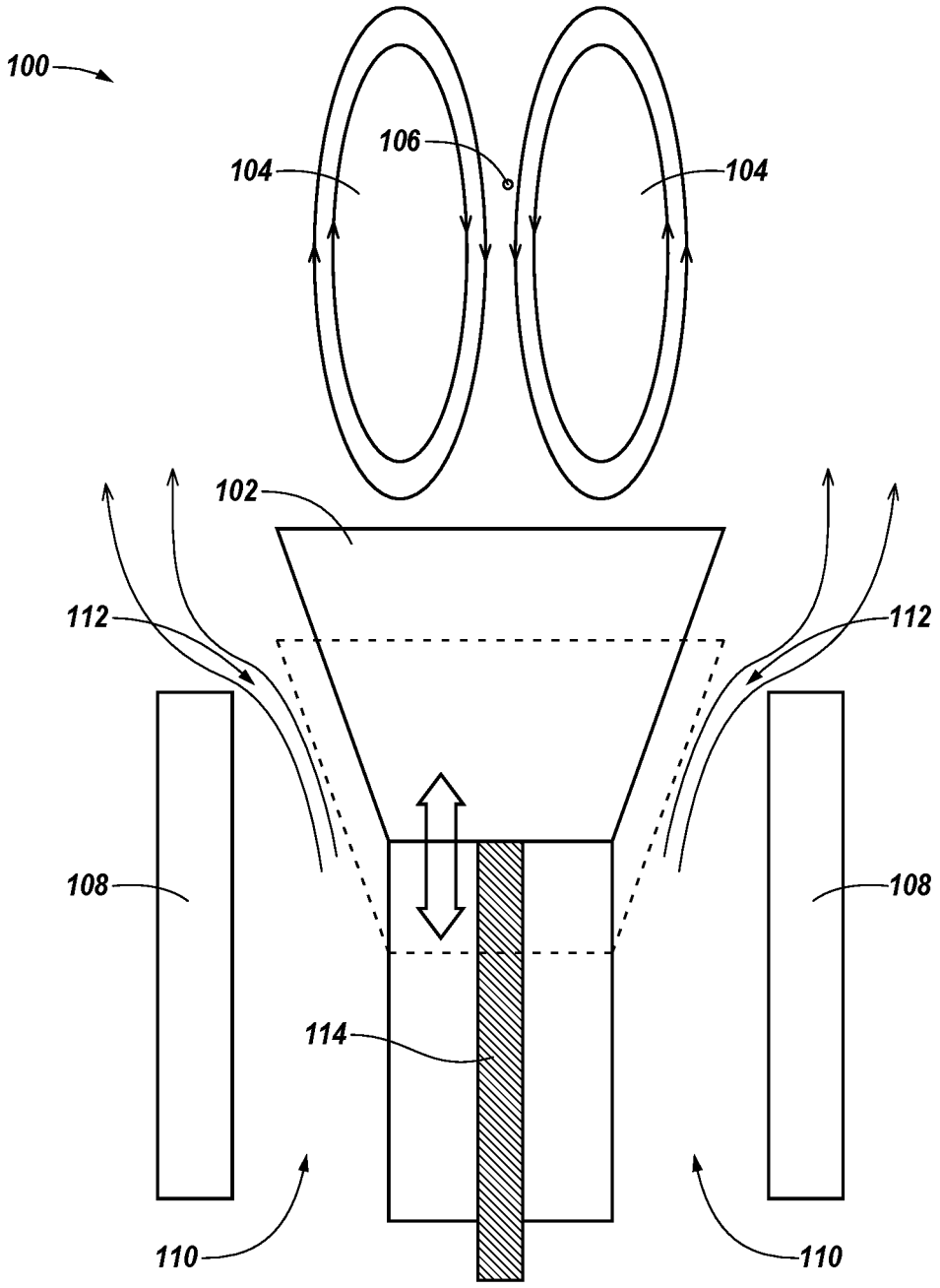
FIGS. 1A-1D illustrate various views of a gaseous fuel-air burner having a bluff body in accordance with one or more embodiments of the present disclosure.

A gaseous fuel-air burner having a bluff body flame stabilizer, and methods of operating the same, are described herein. For example, one or more embodiments include a bluff body configured to stabilize a flame produced by the gaseous fuel-air burner, wherein the bluff body has a conical shape configured to stabilize the flame by generating a recirculation zone having a stagnation point where the flame is stabilized.

A gaseous fuel-air burner bluff body in accordance with the present disclosure can have a conical shape. Further, a gaseous fuel-air burner bluff body in accordance with the present disclosure (e.g., the position of the bluff body in the burner) can be adjustable (e.g., movable). For instance, a bluff body in accordance with the present disclosure can be moved to different positions (e.g., different locations) in the burner during operation of the burner.

In contrast, previous burner bluff bodies may have a circular shape. Further, previous bluff bodies (e.g., the position of previous bluff bodies in the burner) may be fixed (e.g., stationary). For instance, previous bluff bodies may not be movable to different positions in the burner during burner operation, and as such may remain in the same position during burner operation.

Because bluff bodies in accordance with the present disclosure can have a conical shape and/or be adjustable, bluff bodies in accordance with the present disclosure may not overheat during operation of the burner. For example, the conical shape and/or adjustability of the bluff body can prevent the flame produced by the burner (e.g., the stagnation point where the flame is stabilized) from moving closer (e.g., too close) and/or attaching (e.g., anchoring) to the bluff body during operation of the burner, thereby preventing the bluff body from overheating. For instance, the conical shape and/or adjustability of the bluff body can prevent a change in flow conditions, such as a change in the flow rate and/or flow speed, of the burner from causing the flame produced by the burner to move closer to, and overheat, the bluff body. Preventing the bluff body from overheating can prevent the bluff body, and subsequently the burner, from being destroyed.

In contrast, previous bluff bodies (e.g., fixed bluff bodies having a circular shape) may overheat during operation of the burner. For example, the flame produced by the burner may move closer and/or attach to previous bluff bodies during operation of the burner. For instance, a change in flow conditions (e.g., flow rate and/or flow speed) of the burner may cause the flame to move closer to, and overheat, previous bluff bodies, which can destroy the bluff body, and subsequently destroy the burner.

Further, bluff bodies in accordance with the present disclosure (e.g., bluff bodies having a conical shape and/or that are adjustable) can increase the operating range of the burner. For example, bluff bodies in accordance with the present disclosure can increase the turn down (e.g., firing rate) range of the burner. For instance, a burner having a bluff body in accordance with the present disclosure can have a greater operating range, including a greater turn down range, than a burner having a previous bluff body.

Further, because bluff bodies in accordance with the present disclosure can have a conical shape and/or be adjustable, a high pressure drop may not occur in the opening (e.g., gap) between the bluff body and the body of the burner during burner operation. For instance, bluff bodies in accordance with the present disclosure can reduce the pressure drop that occurs in the opening. Because a high pressure drop may not occur in the opening, a high pressure blower and/or high gas pressure may not be needed to operate the burner, which can reduce the operating costs of the burner.

In contrast, a high pressure drop may occur in the opening between previous bluff bodies and the body of the burner during burner operation. As such, a high pressure blower and/or high gas pressure may be needed to operate the burner, which can increase the operating costs of the burner. For instance, the operating costs of a burner having a previous bluff body may be higher than the operating costs of a burner having a bluff body in accordance with the present disclosure.

In the following detailed description, reference is made to the accompanying drawings that form a part hereof. The drawings show by way of illustration how one or more embodiments of the disclosure may be practiced.

These embodiments are described in sufficient detail to enable those of ordinary skill in the art to practice one or more embodiments of this disclosure. It is to be understood that other embodiments may be utilized and that mechanical, electrical, and/or process changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure, and should not be taken in a limiting sense.

The figures herein follow a numbering convention in which the first digit or digits correspond to the drawing figure number and the remaining digits identify an element or component in the drawing. Similar elements or components between different figures may be identified by the use of similar digits.

As used herein, "a" or "a number of" something can refer to one or more such things. For example, "a number of openings" can refer to one or more openings.

Figure 1B:
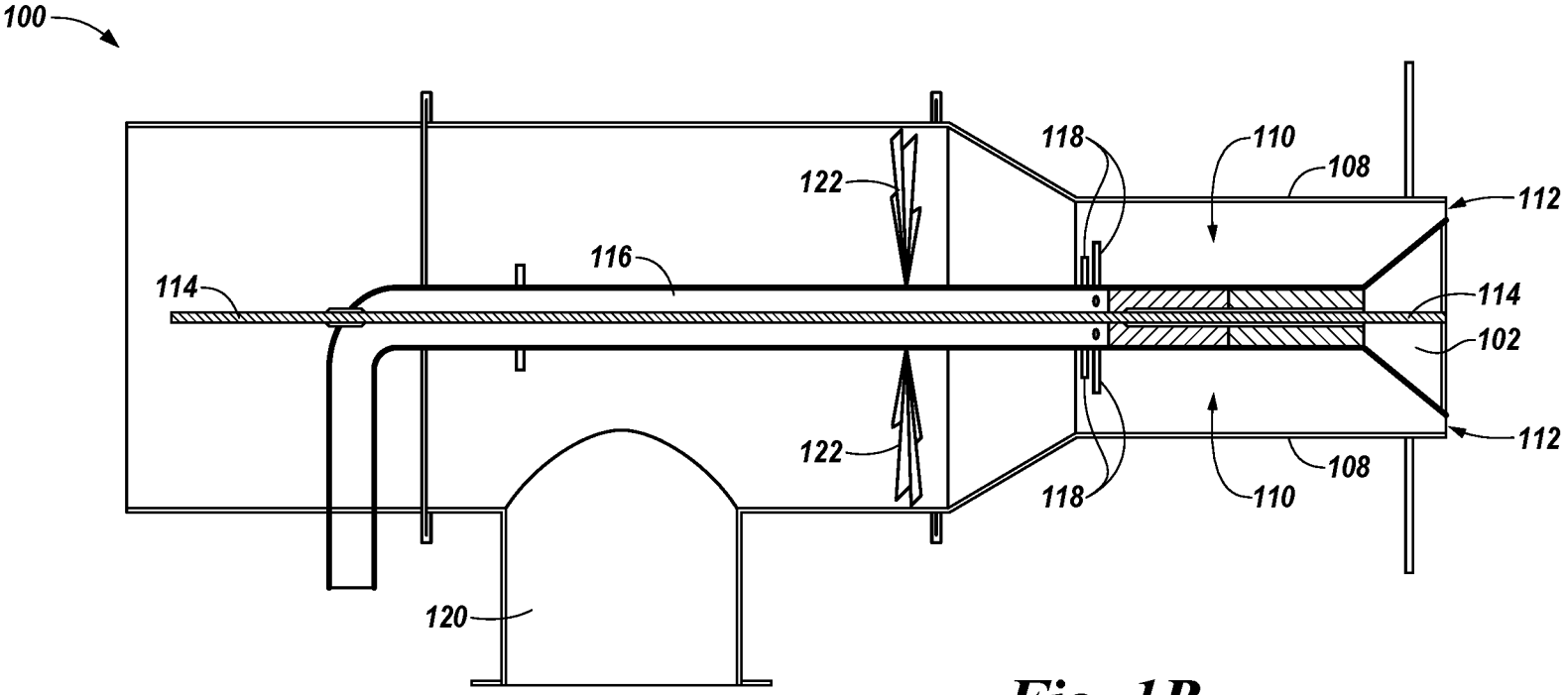
Figure 1C:
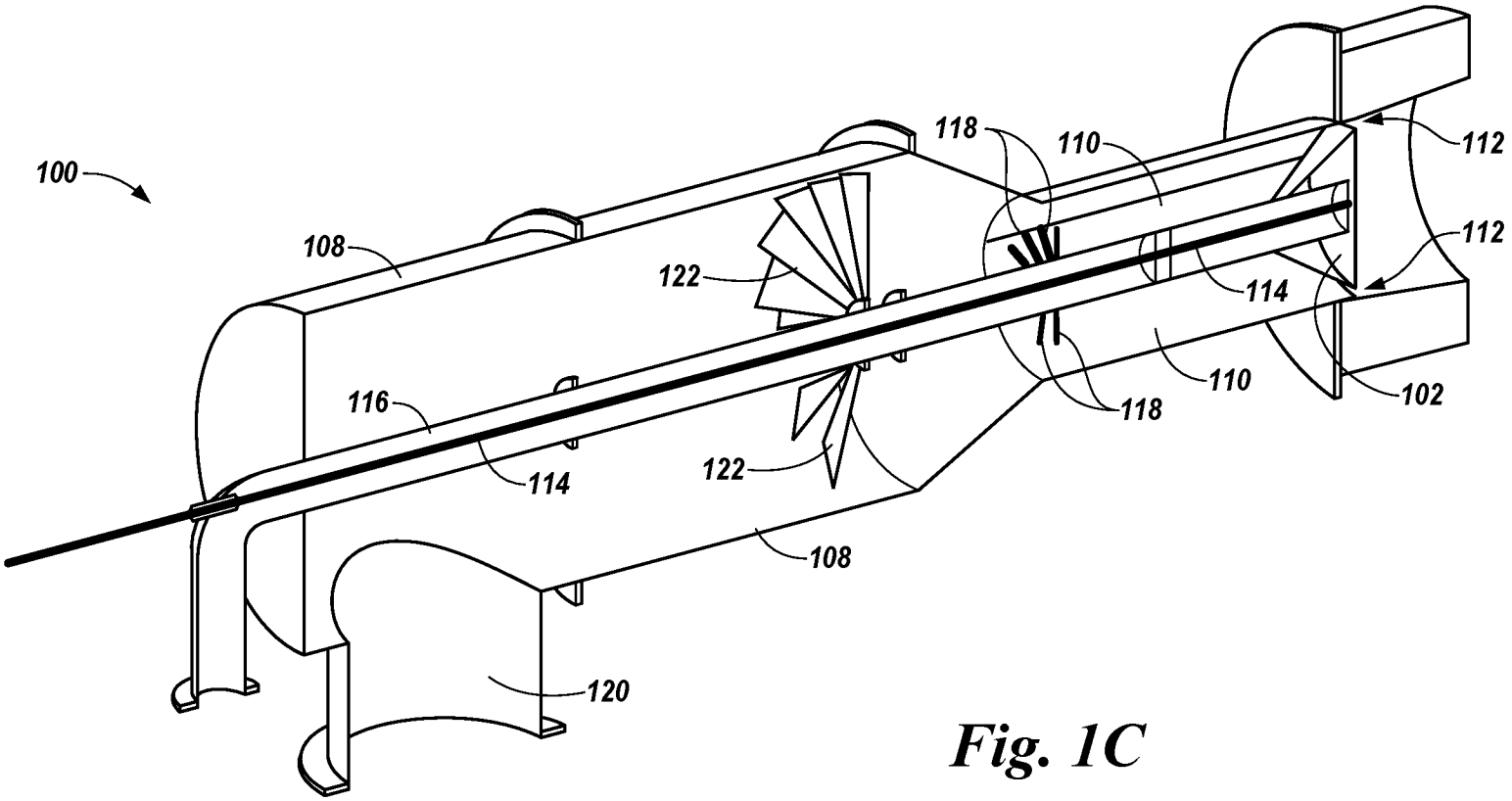
Figure 1D:
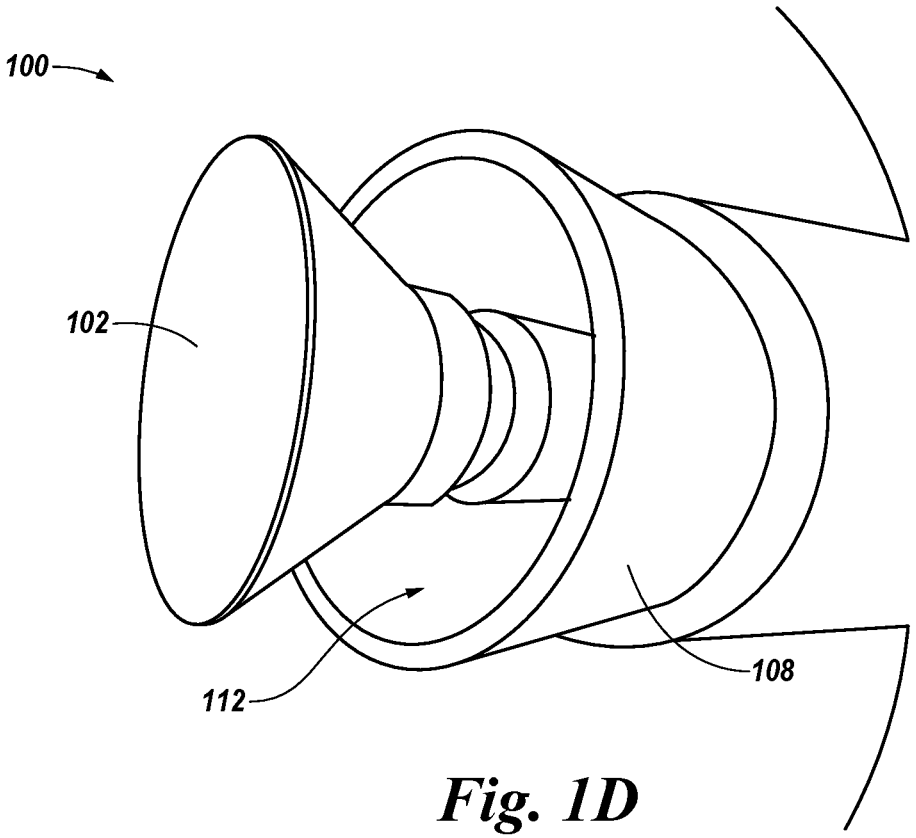

FIGS. 1A-1D illustrate various views of a gaseous fuel-air burner 100 having a bluff body 102 in accordance with one or more embodiments of the present disclosure. For example, FIG. 1A illustrates a schematic top view of a portion of burner 100, FIG. 1B illustrates a schematic cross-sectional view of burner 100, FIG. 1C illustrates an angled cross-sectional view of burner 100, and FIG. 1D illustrates an angled perspective view of a portion of burner 100.

As shown in FIGS. 1A-1D, gaseous fuel-air burner 100 can include a bluff body 102. Bluff body 102 can have a conical shape, as illustrated in FIGS. 1A-1D. Further, bluff body 102 can be an adjustable (e.g., movable) bluff body, such that the position of bluff body 102 in burner 100 is adjustable. For instance, bluff body 102 can be moved to different positions (e.g., different locations) in burner 100 during operation of burner 100, as will be further described herein.

As shown in FIGS. 1A-1C, gaseous fuel-air burner 100 can include a sliding mechanism 114 coupled to bluff body 102. Sliding mechanism 114 can be used to adjust (e.g., move) the position of bluff body 102 in burner 100. For example, sliding mechanism 114 can be moved (e.g., by an operator of burner 100) back and forth in the directions indicated by the double sided arrow illustrated in FIG. 1A, which can result in a corresponding movement of bluff body 102. As shown in FIGS. 1B and 1C, sliding mechanism 114 can be located inside fuel supply connection (e.g., tube) 116 of burner 100, and can extend from bluff body 102 through fuel supply connection 116 until it exits fuel supply connection 116, where it can be accessed (e.g., gripped, grabbed, held, etc.) and moved (e.g. slid) by the operator to move bluff body 102.

Bluff body 102 can be used to stabilize a flame produced (e.g., generated) by gaseous fuel-air burner 100. For example, as illustrated in FIG. 1A, bluff body 102 can stabilize the flame by generating a recirculation zone 104 having a stagnation point 106 where the flame is able to be stabilized.

As an example, bluff body 102 can be positioned at a first position in gaseous fuel-air burner 100 (e.g., the position illustrated in FIG. 1A), and can be used to stabilize a flame produced by the burner while at the first position. Using sliding mechanism 114, bluff body 102 can be moved from the first position to a second position (e.g., the position represented by the dashed lines in FIG. 1A) in burner 100. Bluff body 102 can then stabilize the flame while at the second position.

Bluff body 102 can continue to be moved in a similar manner using sliding mechanism 114 to continue to stabilize flames produced by gaseous fuel-air burner 100. For example, bluff body 102 can be moved from the second position to a third position in burner 100 (not shown in FIG. 1A) using sliding mechanism 114, and can stabilize the flame while at the third position. As an additional example, bluff body 102 can be moved from the second position back to the first position, and can stabilize the flame back at the first position.

As shown in FIGS. 1A-1D, gaseous fuel-air burner 100 can include a body 108, and a channel 110 between body 108 and bluff body 102 and fuel supply connection 116. A gaseous fuel-air mixture used to produce the flame can flow through channel 110, and can exit channel 110 through opening 112 that is adjacent bluff body 102 (e.g., between bluff body 102 and body 108), as represented by the arrows illustrated in FIG. 1A. Bluff body 102 can change (e.g., slow) the velocity of the gaseous fuel-air mixture as it exits channel 110 through opening 112.

As shown in FIGS. 1B and 1C, gaseous fuel-air burner 100 can include a fuel supply connection (e.g., tube) 116 and an air supply connection (e.g., tube) 120. Fuel supply connection 116 can provide the gaseous fuel to channel 110, and air supply connection 120 can provide the air to channel 110. For instance, fuel supply connection 116 can provide the gaseous fuel to channel 110 through openings (e.g., jets) 118. The gaseous fuel from fuel supply connection 116 and the air from air supply connection 120 can mix in channel 110 to form the gaseous fuel-air mixture. For example, although not shown in FIGS. 1A-1D for clarity and so as not to obscure embodiments of the present disclosure, burner 100 can include a blower (e.g., fan) to blow the gaseous fuel-air mixture through channel 110 and opening 112. Such a blower can be mounted to air supply connection 120. Burner can also include a swirler 122, as illustrated in FIGS. 1B and 1C, to guide the air from air supply connection 120 such that the air has a swirling motion as it mixes with the gaseous fuel in channel 110.

The gaseous fuel provided by fuel supply connection 116 can be, for example, hydrogen, propane, or natural gas. However, embodiments of the present disclosure are not limited to a particular type of gaseous fuel.

The conical shape and/or adjustability of bluff body 102 can help prevent bluff body 102 from overheating during operation of burner 100, and therefore can prevent bluff body 102, and subsequently, burner 100, from being destroyed. For example, the conical shape of bluff body 102 can prevent an additional recirculation zone from being generated in channel 110 behind bluff body 102, because the conical shape can allow the gaseous fuel-air mixture to freely exit channel 110 through opening 112. In contrast, previous bluff bodies having a circular (e.g., circular disk and/or plate) shape may generate an additional recirculation zone in the burner channel behind the bluff body, which can cause the flame produced by the burner to attach (e.g., anchor) to the bluff body (especially at slower flow speeds for the gaseous fuel-air mixture through the channel), and thereby cause the bluff body to become overheated and destroyed.

As an additional example, the adjustability of bluff body 102 can prevent a change in flow conditions, such as a change in the flow rate and/or flow speed, of the gaseous fuel-air mixture through channel 110 from causing the flame produced by the burner to move closer to, and overheat, the bluff body, because it can allow for the position of bluff body 102 to be adjusted in response to and/or to compensate for the change in flow conditions. For instance, if the flow conditions of the gaseous fuel-air mixture through channel 110 were to change in a manner that could cause the location of stagnation point 106 to change (e.g., move closer to bluff body 102), the position of bluff body 102 can be adjusted from the first position illustrated in FIG. 1A to the second position to prevent the location of stagnation point 106 from so changing.

In contrast, previous bluff bodies that are fixed, and hence not able to have their position adjusted in response to and/or to compensate for a change in the flow conditions of the gaseous fuel-air mixture through the channel, would not be able to prevent the change in flow conditions from causing the location of the stagnation point to change (e.g., move closer to the bluff body). As such, the change in flow conditions could cause the flame to move closer to the bluff body, and thereby cause the bluff body to become overheated and destroyed.

Further, the conical shape and/or adjustability of bluff body 102 can increase the turn down (e.g., firing rate) range of burner 100, and therefore increase the operating range of gaseous fuel-air burner 100. For example, adjusting the position of bluff body 102 from the first position illustrated in FIG. 1A to the second position can adjust the size of opening 112, which can provide for increased flame stability at different firing rates of burner 100, and therefore increase the range of firing rates at which burner 100 can produce a stabilized flame. That is, increased flame stability for different firing rates of burner 100, and therefore an increased firing rate range of burner 100, can be achieved by adjusting the size of opening 112, and the size of opening 112 can be adjusted by adjusting the position of bluff body 102. The firing rate of burner 100 can be adjusted, for example, using an air valve and/or gas valve. For example, although not shown in FIGS. 1A-1D for clarity and so as not to obscure embodiments of the present disclosure, burner 100 can include an air valve installed prior to where air enters air supply connection 120, and/or a gas valve installed prior to where gas enters fuel supply connection 116, to adjust the firing rate.

As an example, adjusting the position of bluff body 102 to decrease the size of opening 112, such as, for instance, an adjustment of bluff body 102 from the first position illustrated in FIG. 1A to the second position, can increase the stability of a flame produced by gaseous fuel-air burner 100 at a low firing rate by, for example, preventing flashback from occurring in channel 110. That is, increased flame stability for a low firing rate of burner 100 can be achieved by decreasing the size of opening 112. As an additional example, adjusting the position of bluff body 102 to increase the size of opening 112, such as, for instance, an adjustment of bluff body 102 from the second position to the first position illustrated in FIG. 1A, can reduce the pressure drop in opening 112 that may occur at a high firing rate, as will be further described herein. That is, a reduced pressure drop in opening 112, and therefore increased flame stability for a high firing rate of burner 100, can be achieved by increasing the size of opening 112.

In contrast, previous bluff bodies that are fixed, and hence not able to have their position adjusted, may not be capable of providing increased flame stability at different (e.g., low and/or high) firing rates of the burner. As such, the operating range of gaseous fuel-air burner 100 having bluff body 102 may be greater than a burner having a previous (e.g., fixed) bluff body.

Further, the conical shape and/or adjustability of bluff body 102 can prevent a high pressure drop from occurring in opening 112 between bluff body 102 and body 108 of gaseous fuel-air burner 100 during operation of burner 100. For instance, adjusting the position of bluff body 102 can adjust (e.g., reduce) the pressure drop that occurs in opening 112 by adjusting (e.g., decreasing) the size of opening 112. That is, the pressure drop that occurs in opening 112 can be adjusted by adjusting the size of opening 112, and the size of opening 112 can be adjusted by adjusting the position of bluff body 102. As an example, adjusting the position of bluff body 102 to increase the size of opening 112 can reduce the pressure drop that occurs at opening 112.

Adjusting the position of bluff body 102 to adjust (e.g., reduce) the pressure drop in opening 112 can stabilize a flame produced by gaseous fuel-air burner 100 at a high firing rate. As such, burner 100 can be operated at a high firing rate with good combustion performance without requiring a high air pressure. As such, the blower of the burner does not need to be a high speed or high pressure blower to prevent a high pressure drop from occurring in opening 112, which can reduce the operating costs of burner 100.

In contrast, previous bluff bodies that are fixed, and hence not able to have their position adjusted, may not be capable of reducing the pressure drop that may occur in the opening between the bluff body and the body of the burner. As such, a high speed or high pressure blower may be needed to prevent a high pressure drop from occurring in the opening and stabilize the flame produced by the burner at a high firing rate, which can increase the operating costs and/or reduce the operating range of the burner. For instance, the operating costs of a burner having a previous bluff body may be higher than the operating costs of burner 100 having bluff body 102.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A gaseous fuel-air burner, comprising:

an adjustable bluff body configured to stabilize a flame produced by the gaseous fuel-air burner having a central axis, the adjustable bluff body coaxial with the central axis and has a conical shape configured to stabilize the flame by generating a recirculation zone in front of the bluff body while preventing a recirculation zone behind the bluff body and having a stagnation point where the flame is stabilized; and a sliding mechanism coupled to the adjustable bluff body and configured to adjust the position of the adjustable bluff body in the burner so as to decrease the size of a burner opening by covering a majority of the burner opening.

2. The gaseous fuel-air burner of claim 1, wherein the gaseous fuel-air burner includes:

a body;

a channel through which a gaseous fuel-air mixture flows; and an opening between the bluff body and the body through which the gaseous fuel-air mixture exits the channel.

3. The gaseous fuel-air burner of claim 2, wherein the conical shape of the bluff body is configured to prevent a recirculation zone from being generated in the channel.

4. The gaseous fuel-air burner of claim 2, wherein the bluff body is configured to change a velocity of the gaseous fuel-air mixture as the gaseous fuel-air mixture exits the channel.

5. A method of operating a gaseous fuel-air burner, comprising:

producing a flame;

stabilizing the flame using an adjustable bluff body on a central axis of the burner at a first position in the gaseous fuel-air burner;

adjusting the adjustable bluff body from the first position to a second position in the gaseous fuel-air burner using a sliding mechanism coupled to the adjustable bluff body and configured to adjust the position of the adjustable bluff body in the burner; and stabilizing the flame by generating a recirculation zone in the front of the bluff body while preventing a recirculation zone behind the bluff body using the adjustable bluff body at the second position so as to decrease the size of a burner opening by covering a majority of the burner opening.

6. The method of claim 5, wherein the method includes increasing a stability of the flame by adjusting the bluff body from the first position to the second position.

7. The method of claim 5, wherein:

stabilizing the flame includes generating a recirculation zone having a stagnation point where the flame is stabilized; and adjusting the bluff body from the first position to the second position prevents a location of the stagnation point from changing.

8. The method of claim 7, wherein adjusting the bluff body from the first position to the second position prevents the location of the stagnation point from moving closer to the bluff body.

9. The method of claim 5, wherein the method includes adjusting a size of an opening between the bluff body and a body of the gaseous fuel-air burner through which a gaseous fuel-air mixture flows by adjusting the bluff body from the first position to the second position.

10. The method of claim 9, wherein:

adjusting the size of the opening between the bluff body and the body of the gaseous fuel-air burner includes increasing the size of the opening; and the method includes reducing a pressure drop that occurs at the opening by increasing the size of the opening.

11. The method of claim 5, wherein the method includes:

adjusting the bluff body from the second position to a third position in the gaseous fuel-air burner; and stabilizing the flame using the bluff body at the third position.

12. The method of claim 5, wherein the method includes:

adjusting the bluff body from the second position back to the first position; and stabilizing the flame using the bluff body back at the first position.

13. A gaseous fuel-air burner, comprising:

an adjustable bluff body moveable coaxially along a central axis of the gaseous fuel-air burner and configured to stabilize a flame by generating a recirculation zone in front of the bluff body while preventing a recirculation zone behind the bluff body wherein the flame is produced by the gaseous fuel-air burner; and a sliding mechanism coupled to the adjustable bluff body and configured to adjust the position of the adjustable bluff body in the burner;

wherein:

the adjustable bluff body has a conical shape; and a position of the adjustable bluff body in the gaseous fuel-air burner is adjustable so as to decrease the size of a burner opening by covering a majority of the burner opening.

14. The gaseous fuel-air burner of claim 13, wherein the gaseous fuel-air burner includes:

a channel through which a gaseous fuel-air mixture flows; and an opening adjacent the bluff body through which the gaseous fuel-air mixture exits the channel.

15. The gaseous fuel-air burner of claim 14, wherein the position of the bluff body in the gaseous fuel-air burner is adjustable to decrease a size of the opening.

16. The gaseous fuel-air burner of claim 13, wherein the position of the bluff body in the gaseous fuel-air burner is adjustable to increase a size of the opening.

17. The gaseous fuel-air burner of claim 16, wherein the position of the bluff body in the gaseous fuel-air burner is adjustable to reduce a pressure drop that occurs at the opening.

* * * * *